US008246797B2

(12) United States Patent
Botrel et al.

(10) Patent No.: US 8,246,797 B2
(45) Date of Patent: Aug. 21, 2012

(54) SURFACE TREATMENT ELECTRODE

(75) Inventors: Ronan Botrel, Marey S/Tille (FR); Herve Bourcier, Touillon (FR)

(73) Assignee: Commissariat a l'Energie Atomique, Paris (FR)

( * ) Notice: Subject to any disclaimer, the term of this patent is extended or adjusted under 35 U.S.C. 154(b) by 1270 days.

(21) Appl. No.: 11/887,896

(22) PCT Filed: Apr. 3, 2006

(86) PCT No.: PCT/FR2006/000732

§ 371 (c)(1),
(2), (4) Date: Oct. 2, 2007

(87) PCT Pub. No.: WO2006/106221

PCT Pub. Date: Oct. 12, 2006

(65) Prior Publication Data

US 2009/0014321 A1 Jan. 15, 2009

(30) Foreign Application Priority Data

Apr. 4, 2005 (FR) ..... 05 50877

(51) Int. Cl.
*C25D 17/06* (2006.01)
*C25D 17/12* (2006.01)
*C25F 7/00* (2006.01)

(52) U.S. Cl. ..... 204/297.01; 205/145; 205/148; 205/150; 205/653; 205/672

(58) Field of Classification Search ..... 205/143
See application file for complete search history.

(56) References Cited

U.S. PATENT DOCUMENTS

| | | | | |
|---|---|---|---|---|
| 3,823,074 | A * | 7/1974 | Minbiole et al. | 205/145 |
| 3,823,083 | A * | 7/1974 | Minbiole et al. | 204/237 |
| 4,139,424 | A * | 2/1979 | Herrnring | 205/103 |
| 4,316,786 | A | 2/1982 | Yu et al. | 204/223 |

FOREIGN PATENT DOCUMENTS

| | | |
|---|---|---|
| DE | 2543599 A1 | 4/1977 |
| GB | 1301678 | 1/1973 |
| JP | 58-81990 | 5/1983 |

OTHER PUBLICATIONS

French Preliminary and PCT Search Report, PCT/FR2006/000732, (May 7, 2007), 5 pgs.; FA 666095 & FR 0550877, (Jun. 10, 2005) 3 pgs.

* cited by examiner

*Primary Examiner* — Harry D Wilkins, III
(74) *Attorney, Agent, or Firm* — Nixon Peabody LLP

(57) ABSTRACT

The invention concerns a surface treatment electrode (11) to treat at least one object (1). It comprises at least one cavity (23) enclosing the object (1) to be treated during the treatment, having a geometry ensuring free movement of the object (1), this cavity (23) being delimited by a wall (24) comprising at least one opening (25) communicating the inside of the cavity (23) with a treatment solution (5) in which the electrode (11) is immersed during the surface treatment. The cavity (23) is substantially cylindrical and its diameter is approximately 50 to 100 micrometers larger than a maximum size of the object (1).

23 Claims, 11 Drawing Sheets

SURFACE TREATMENT ELECTRODE

CROSS REFERENCE TO RELATED APPLICATIONS OR PRIORITY CLAIM

This application is a national phase of International Application No. PCT/FR2006/000732 entitled "Surface Processing Electrode", which was filed on Apr. 03, 2006, which was not published in English, and which claims priority of the French Patent Application No. 05 50877 filed Apr. 04, 2005.

TECHNICAL AREA

The present invention relates to an electrode for the surface treatment of objects. This electrode is particularly suitable for application of an oxidoreduction method to deposit metal on objects, to achieve the depositing of gold for example on solid or hollow microspheres, respectively called microbeads and microballoons, in polymer or glass, used in particular in physics for studies on power lasers. It can also be used to metallize beads whether metallic or not, used in different areas such as the manufacture of heat or pressure sensors, dielectric biomedical sensors, or optical sensors. It can also be used to metallize various objects, in particular very small-sized objects whose dimensions and/or fragility do not allow direct electric connection for electrolytic or chemical galvanic deposit, or the use of bulk barrel plating e.g. for electronic microcomponents or time-keeping instruments. Finally, the electrode can also be used for electrochemical or chemical polishing, or for other surface treatments such as degreasing, anodizing, phosphatizing or nitriding.

STATE OF THE PRIOR ART

Some physics experiments on power lasers require the use of microballoons used as targets. These microballoons, made in polymer or glass for example, are spheres or quasi-spheres each comprising a central cavity limited by a wall, whilst microbeads are solid spheres or quasi-spheres. Generally, these microballoons or microbeads have a diameter of around 100 micrometers, and the wall of each microballoon is approximately a few micrometers thick. For the needs of these experiments, microballoons must be coated with a metal layer, such as gold for example, having a thickness in the region of 10 micrometers. To obtain the best results possible during these experiments, the thickness of the metal deposit on the microballoon must be as homogeneous as possible, its density must be as close as possible to the theoretical density of the deposited metal, the deposit material must not have any material health defect and its surface roughness must not exceed one hundred or so nanometers. These parameters are difficult to control since they may vary from one microballoon to another. Additionally, it would be of interest during the deposit operation to be able to monitor each microballoon individually so as to characterize the deposit obtained on the microballoons with as much accuracy as possible. The same applies to microbeads.

There are different depositing techniques which can be used to metallize an object.

Physical Vapour Deposition (PVD) methods exist, allowing a metal layer to be deposited on an object. With this type of method, deposits of narrow thickness and good quality can be achieved. But when the deposit reaches a thickness in the region of a few micrometers, the physical properties of the thick layers obtained are often inferior (high roughness, stresses, porous deposit). PVD methods also tend to heat the substrate used, sometimes causing deformation of the substrate, especially if it is a polymer substrate. Also PVD depositing rates are much slower than those obtained with other techniques described below.

Oxidoreduction depositing techniques can be divided into two different categories:

- chemical deposit by immersion which consists of providing the electrons required for reducing the metal to be deposited by exchange between two redox pairs. The reducer which oxidizes to generate the electrons may either be the metal to be covered, in which case this is called chemical deposit by displacement, or it may be a soluble ionic reduced form able to be oxidized, in which case this is called chemical deposit by reduction. These electrons can also be provided by electric contact between the object to be metallized and another less noble metal having a stronger propensity to oxidize, the object and the other metal being immersed in one same solution of metal to be deposited: this is chemical deposit by contact or galvanic action. With chemical deposit by immersion, depositing is initiated as soon as the parts are immersed in the deposit solution, the redox reaction then taking place naturally with no external power supply;
- electrolytic deposit which consists of providing the electrons required for reducing the metal to be deposited by conducting an electrochemical reaction between an electrode and the metal to be deposited contained in the deposit solution. For this purpose, the object to be metallized is negatively polarized by connecting it to a negative pole of a current source. A positive pole of the current source is connected to an anode which is also immersed in the deposit solution which acts as site of exchange for the combined oxidization reaction. The power source may deliver a direct current, but also an alternating current: this is then termed a pulsed-current deposit. In this case, the form of the electric signal is imposed and controlled. This gives rise successively, in relation to the current sign, to a reducing or oxidizing reaction which takes place on the surface of the object to be metallized, which may in some cases improve the deposit.

Chemical deposit methods by displacement or reduction provide excellent homogeneity of the deposit thickness. For some metals however, gold in particular, they do not allow deposit thicknesses of more than one micrometer to be obtained.

Also, among existing physical vapour deposition or chemical immersion methods, most require the use of a support to hold the object to be metallized, and as a result a hole is created in the thickness of the deposit after separating the support from the object. The presence of this hole is a material health defect, which is unacceptable with respect to the desired quality of deposit.

The principle of chemical deposit by galvanic action has long been known. With this depositing technique it is possible to obtain a very homogeneous deposit thickness. It is used for very thin deposits such as for plating gold and silver ware, since it entails the attack of one of the electrodes, the electrode whose metal oxidizes. This generates dissolution of this metal in the deposit solution and hence a risk of polluting the deposited layer. Also, the electrode which has the metal which oxidizes during the depositing operation, itself tends to become coated with the metal to be deposited, which leads to a sharp drop in depositing rate and makes the process difficult to control.

Electrolytic depositing processes can be used to obtain deposits with no limit as to their thickness. However, to metallize an object of very small size with existing systems it is difficult to control the homogeneity of the deposit thickness in reproducible manner owing to the distribution of current lines. Additionally, these electrolytic depositing methods require the use of a power feed to allow an electrolysis current to pass through the object to be metallized, or the use of a supporting holder fixed to the surface of the object to be metallized. This consequently leads to the formation of a hole in the deposit thickness after separating the power feed from the object, a consequence which is inconceivable with regard to the requirement for a zero material health defect on the deposit surface.

Existing electrolysis cells described in the literature, which may possibly be used to metallize very small objects such as microballoons, and which do not use a power feed or a supporting holder fixed to the object to be metallized, are designed to metallize several objects at the same time. The drawback is the risk of impacts and the formation of surface defects caused by contact between these objects.

American U.S. Pat. No. 4,316,786 describes a device intended to metallize microballoons in glass. This device comprises an electrolysis cell having an anode and a cathode connected to a current generator. The cell contains an aqueous deposit solution and the microballoons to be metallized. By applying a direct current between the electrodes, a deposit is made on the cathode and on the microballoons in direct contact with it. In order to obtain a more or less homogeneous deposit, the microballoons are placed in movement by the cathode which is set in vibration.

However, this electrolysis cell has several major disadvantages. First it requires the application of a current that is proportional to the deposit surface. However since microballoons are extremely small compared with the cathode, several microballoons have to be placed in the cell to reduce the surface ratio between the cathode and the microballoons in the hope of obtaining a better distribution of current lines. Under these conditions, contacts between the microballoons are inevitable. Therefore some microballoons may adhere together and the deposit may be damaged by successive impacts. Additionally, current density gradients cannot be avoided from one microballoon to another making it difficult to gain control over the homogeneity of deposit thickness and smoothness in reproducible manner. Finally, since several microballoons are placed simultaneously in the aqueous solution, it is impossible to monitor each one individually and hence to be able to characterize the deposit with accuracy. Characterization of the deposit therefore essentially depends upon the geometric disparity of the microballoons.

DESCRIPTION OF THE INVENTION

The object of the present invention is to propose an electrode to implement, for example, a metal deposition method by oxidoreduction which, in relation to the metal to be deposited and the depositing technique used, allows any deposit thickness to be obtained which in terms of homogeneity, smoothness, material health defect, density lying as close as possible to the theoretical density of the deposited metal, allows a better quality to be achieved than with prior art methods and devices. A further object of the present invention is to propose an electrode allowing the implementation of various methods for the surface treatment of objects, such as electrochemical or chemical polishing, enabling removal of material from the object, which in terms of homogeneity, surface smoothness, material health defect, achieves better quality than obtained with prior art methods and devices.

To attain these purposes, the present invention proposes an electrode for the surface treatment of at least one object, the electrode comprising at least one cavity containing the object to be treated during the treatment operation, and whose geometry ensures free movement of the object, this cavity being delimited by a wall comprising at least one opening providing communication between the inside of the cavity and a treatment solution in which the electrode is immersed during the surface treatment.

Said cavity may be substantially cylindrical, with a diameter that is approximately 50 to 100 micrometers greater than a maximum size of the object.

Therefore instead of using a device requiring the use of a supporting holder or a power feed, an electrode is used which, whilst ensuring free motion of the object, avoids leaving a defect either in the metal plating or in the removed material which would be caused by the presence of a supporting holder or current feed during the treatment.

With this electrode it is also possible to avoid the problems encountered with devices which plate several objects simultaneously, these problems being described above in the state of the prior art.

Finally for chemical galvanic depositing, this reduction electrode allows any deposit thickness to be obtained, unlike existing devices using galvanic chemical deposition.

It is possible to make provision for the cavity wall to have an orifice though which the object can be inserted, this orifice being intended to be plugged by a stopper.

The opening in the cavity wall may be of a size guaranteeing circulation of the deposit solution within the cavity while preventing the object from escaping from the cavity.

The opening may be a slot whose width is smaller than the radius of an object of spherical or near-spherical shape.

It is possible for the electrode to comprise a plurality of cavities so that it can simultaneously receive a plurality of objects, the cavities possibly being substantially superimposed over each other in columns, or arranged substantially beside one another in a ring.

The electrode may be formed of a body joined to a removable head which comprises the cavity, in which case it is easy to change the head for example if it becomes too coated with a layer of metal to be deposited.

Provision may be made to coat the body with an insulating coating such as a dielectric shield, for example to protect it against the metal to be deposited.

The head may be formed of two parts assembled together, one first part being joined to the body forming a chamber with a gas inlet orifice, and a second part comprising the cavity, these two parts communicating with each other.

As a variant, it could be contemplated to provide the cavity wall directly with the gas inlet orifice, and the chamber is therefore no longer necessary.

The electrode may be a reduction electrode for implementing an oxidoreduction method to deposit metal on the object that it is metallized at least on its surface, the treatment solution then being a deposit solution.

The electrode may be made at least partly in brass if the metal to be deposited is gold.

If the deposit is a chemical deposit by displacement or reduction, the electrode may be made at least in part in a non-metal material such as polyvinyl chloride (PVC) or tetrafluoroethylene polymer, to prevent any local galvanic corrosion between the object to be metallized and the electrode.

If deposition is electrolytic or by chemical galvanic action, it is advantageous that the cavity should have a geometry that ensures electric contact of the object with the wall as frequently as possible during the free movement of the object in the cavity.

The electrode may be an oxidation electrode to implement an oxidoreduction electrochemical polishing process of the object metallized at least on its surface, said electrode possibly being made at least in part in an electrically conductive material which does not interfere with the oxidoreduction process involved, the cavity possibly having a geometry ensuring electric contact of the object with the wall as frequently as possible when it moves freely within the cavity.

The electrode may be made at least in part in a material that is inert to the treatment solution.

The present invention also concerns a method for the surface treatment of at least one object, comprising the steps consisting of:

immersing, in a treatment solution, at least one electrode subject of the present invention, for surface treatment of the object;

agitating the treatment solution to place the object in movement and in suspension in the treatment solution so that said treatment solution acts on the object.

The surface treatment may be a metal deposit by oxidoreduction on the object metallized at least on its surface, the treatment solution possibly being a deposit solution containing ions of the metal to be deposited, the surface treatment electrode possibly being a reduction electrode such as described previously.

If the deposit is a chemical deposit by displacement or reduction, the reduction electrode may be made at least partly in a non-metal material such as polyvinyl chloride or tetrafluoroethylene polymer to avoid any local galvanic corrosion between the object to be metallized and the electrode, which would deteriorate the inner side of the electrode and hence might risk deteriorating the object to be plated.

If the deposit is a chemical deposit by chemical galvanic action, the method may additionally comprise a step consisting of also immersing in the deposit solution at least one oxidation electrode made in a metal having a greater reducing power than the metal to be deposited, this oxidation electrode being electrically connected to the reduction electrode either directly or via a coulometer.

If the deposit is to be made by electrolysis, the method may additionally comprise a step consisting of also immersing in the deposit solution at least one oxidation electrode made in a metal which does not pollute the deposit solution during its oxidation, this oxidation electrode being electrically connected to the reduction electrode via a power source.

If the deposit is a chemical deposit by chemical galvanic action, to prevent early wear of the oxidation electrode, the metal of the oxidation electrode may be immersed in a conductive solution placed in a container sealed by at least one ion junction allowing electric contact between the conductive solution and the deposit solution without mixing the two together.

The ion junction may be a glass sinter or gelatine ion junction.

If the depositing method uses chemical galvanic action, the metal of the oxidation electrode may be aluminium.

Preferably, the surface metal of the object is compatible in terms of electronegativity and adhesion in order to receive the metal in the deposit solution.

The surface metal of the object may be chosen from gold, copper, nickel.

The metal to be deposited may be chosen from gold, copper, nickel or any other metal which can be deposited in an aqueous solution.

The deposit thickness may be in the region of a few nanometers to a few dozen micrometers.

The surface treatment may be electrochemical polishing by oxidoreduction of the object metallized at least on its surface, the surface treatment electrode possibly being an oxidation electrode to conduct an electrochemical polishing method by oxidoreduction, said method possibly additionally comprising a step consisting of also immersing in the treatment solution at least one metal reduction electrode, this reduction electrode possibly being electrically connected to the oxidation electrode via a power source.

A gas may be injected into the cavity during the depositing operation, compelling the object to move within the cavity.

Injection may preferably be made intermittently.

The gas may preferably be a neutral gas so as not to modify the pH of the deposit solution.

It is possible to heat the deposit solution during the depositing operation.

The object to be metallized may be in polymer, in glass or any other solid material such as ceramic or metal for example.

The object to be metallized may be a microballoon or microbeads. The wall of the microballoon may have a thickness of a few micrometers.

The diameter of the object may range from around 100 micrometers to 2 millimeters.

The treatment solution may be an aqueous potassium aurocyanide solution.

The present invention also concerns a device to implement a method for the surface treatment of an object, comprising:

a receptacle intended to contain a treatment solution;

means to agitate the treatment solution;

at least one treatment electrode, subject of the present invention, such as described previously, to be placed in the receptacle.

The treatment method may be a metal depositing method by redox reaction, the treatment solution possibly being a deposit solution, the surface treatment electrode possibly being a reduction electrode to conduct a metal depositing method by oxidoreduction.

The device may also comprise at least one oxidation electrode to be placed in the receptacle and connected electrically to the reduction electrode either directly or via a coulometer, when the method used is chemical deposit by chemical galvanic action.

The device may also comprise at least one oxidation electrode to be placed in the receptacle and electrically connected to the reduction electrode via a power source, if the depositing method used is an electrolytic method.

It may be envisaged to provide the device with means for heating the treatment solution.

Means may be provided to control the temperature of the treatment solution, such as an electronic thermometer with thermocouple to be immersed in the treatment solution.

It is preferable for the device to include means for injecting gas into the gas inlet orifice of the treatment electrode.

The gas injection means may for example be at least one capillary connecting the orifice to a peristaltic pump or to a gas circuit comprising a flow regulating valve.

It could be envisaged that the agitation means are magnetic means, ultrasound means or a device which comes to strike the treatment electrode.

BRIEF DESCRIPTION OF THE DRAWINGS

The present invention will be better understood on reading the description of examples of embodiment given solely for illustration purposes and in no way limiting, with reference to the appended drawings in which.

Identical, similar or equivalent parts in the different figures described below carry the same reference numbers to facilitate cross-reading of the figures.

The different parts illustrated in the figures are not necessarily shown to scale, for better legibility of the figures.

DETAILED DESCRIPTION OF PARTICULAR EMBODIMENTS

Figure 1A:
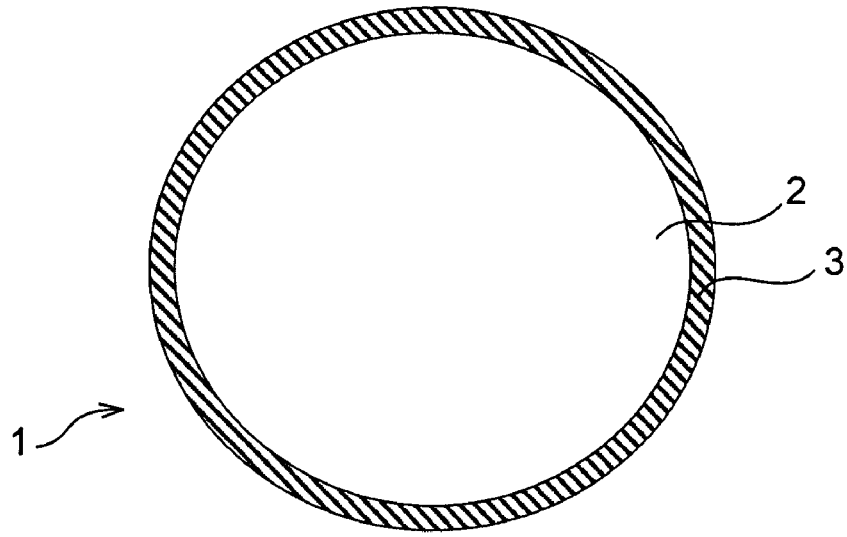
FIG. 1A is an example of an object to be plated.

With reference firstly to FIG. 1A, which shows an example of an object 1 to be metallized. In this example, the object 1 to be metallized is a microballoon 1. The microballoon 1 is a sphere or quasi-sphere having a central cavity 2 limited by a wall 3. Its diameter generally lies between approximately 100 micrometers and 2 millimeters. The thickness of the wall 3 of the microballoon 1 is generally a few micrometers. The object 1 to be metallized could also be a microbeads i.e. a solid sphere or quasi-sphere. But the object 1 to be metallized could be any part, non-spherical, of more complex geometry and of greater size.

In this example, the microballoon 1 is in glass or polymer, but could be in another material e.g. metal. This type of object 1 is extremely fragile and hence requires many precautions to be taken for its handling.

Figure 1B:
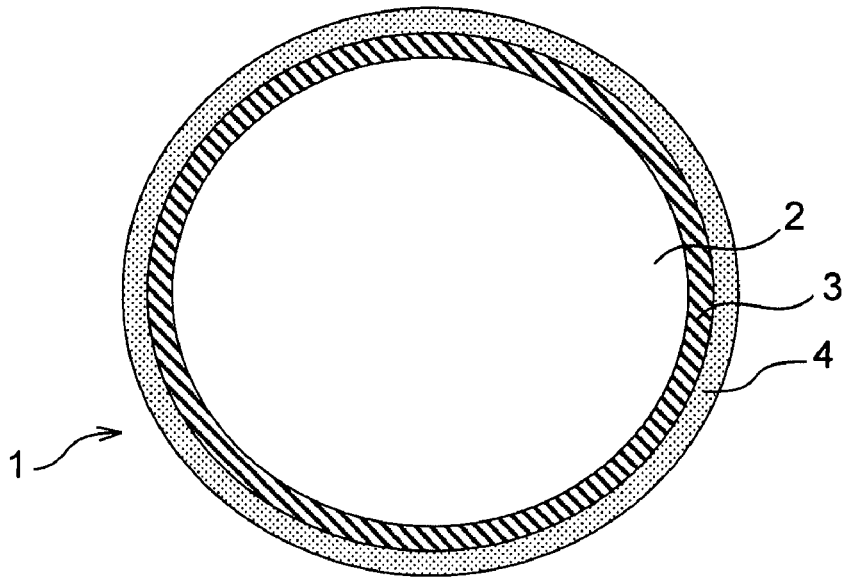
FIG. 1B is an example of an object, that is surface metallized, to be plated.

If the object 1 to be metallized is not metallic, before starting a metal deposition method, subject of the present invention, the object 1 must be metallized at least on its surface 4, such as illustrated FIG. 1B. The metal used for this surface metallization 4 is electronegatively and adhesively compatible with the metal to be deposited according to the deposit method, subject of the present invention, described below. This surface metal 4 may be gold for example, copper or nickel.

Figure 2:
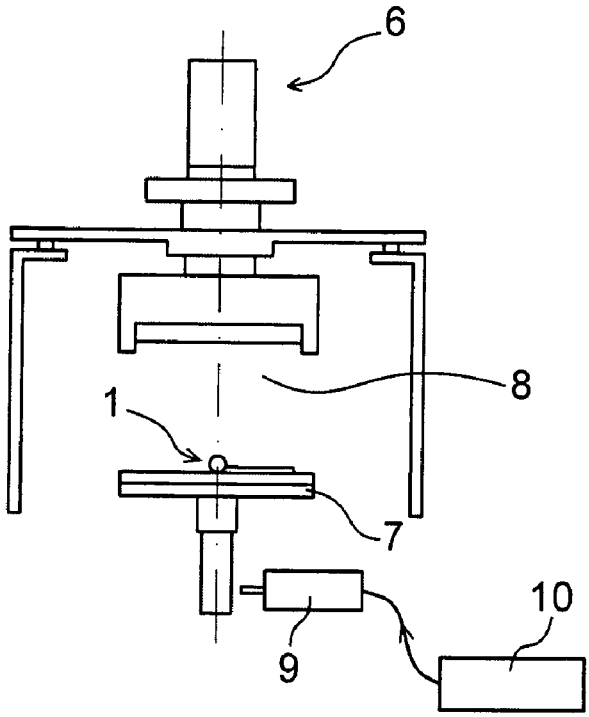
FIG. 2 is an example of a surface metallizing device.

In the described example of embodiment, this surface metallization 4 is performed by a surface metallization device 6 shown FIG. 2. This device 6 comprises a dish 7. This dish 7 is intended to receive one or more objects 1 to be simultaneously surface metallized. In this example, only the object 1 is surface metallized. The dish 7 is placed in a Physical Vapour Deposition chamber 8. The device 6 has a piston 9 servo-controlled by a signal generator 10 which sets the dish 7 in vibration during the surface metallization 4 of the object 1. The signal generator 10 sends command signals to the piston 9 which then strikes the dish 7. The vibrations of the dish 7 set the object 1 in motion throughout the metallization operation. This yields a very homogeneous metallization layer 4 over the entire surface of the object 1. The thickness of metal obtained is between 50 nanometers and 100 nanometers for example. 50 nanometers is approximately the minimum thickness required to guarantee sufficient adhesion of the metal layer which is to be subsequently deposited.

We will now turn our attention to the application of a metal deposition method by oxidoreduction, subject of the present invention, on at least the object 1. With this method it is possible, over the previously obtained surface metallization 4 of object 1, to deposit a thicker metal layer using a deposit solution.

Four techniques can be used to achieve this deposit:

a chemical deposit technique by displacement;

a chemical deposit technique by reduction;

a chemical deposit technique by galvanic action;

an electrolytic depositing technique.

For these four techniques, between the metal in the deposit solution e.g. gold and a less noble metal e.g. aluminium which has greater reducing power than the metal to be deposited, the principle is to obtain a galvanic pair. The less noble metal is immersed in the deposit solution containing ions of the metal to be deposited. Since aluminium has greater reducing power than gold, the aluminium will be converted to ion form in the deposit solution following the reaction (1):

$$Al \rightarrow Al^{3+} + 3e^- \quad (1)$$

The electrons thus released will enable the gold, in ion form in the solution, to be deposited on the surface metallization 4 of the object 1, following the reaction (2):

$$Au^+ + e^- \rightarrow Au \quad (2)$$

Depositing of the gold continues in this manner for as long as the two parts of the galvanic pair remain physically and electrically linked, i.e. for as long as gold remains in the deposit solution and for as long as the aluminium converts to ion form.

Figure 3A:
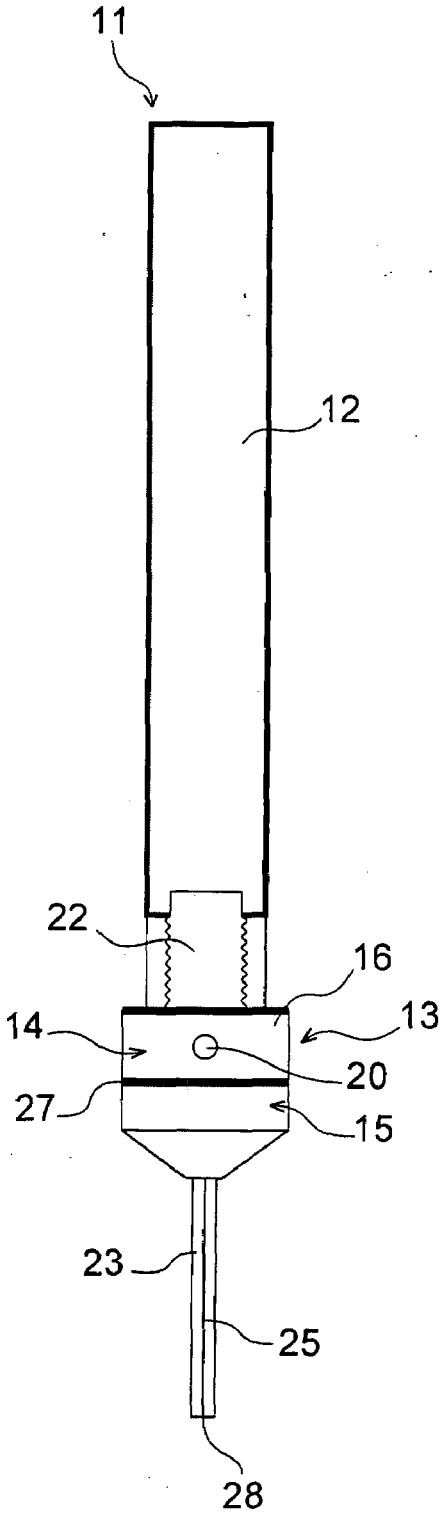
FIG. 3A is a diagram of a treatment electrode, subject of the present invention, according to a first embodiment.

To achieve this metal deposit, a reduction electrode 11, subject of the present invention, is used. It is this reduction electrode 11 which will allow the desired quality and thickness of the deposit to be obtained. An example of embodiment of this reduction electrode 11 is shown FIG. 3A. It comprises at least one cavity 23 which can be seen FIG. 7. This cavity 23 is intended to enclose the object 1 during the deposit operation. Its geometry ensures free movement of the object 1. This cavity 23 is delimited by a wall 24 which can also be seen FIG. 7.

If the metal deposition method is electrolytic or chemically galvanic, the cavity 23 has a geometry which ensures electric contact of the object 1 with the wall 24 as frequently as possible during its free movement within the cavity 23.

Figure 7:
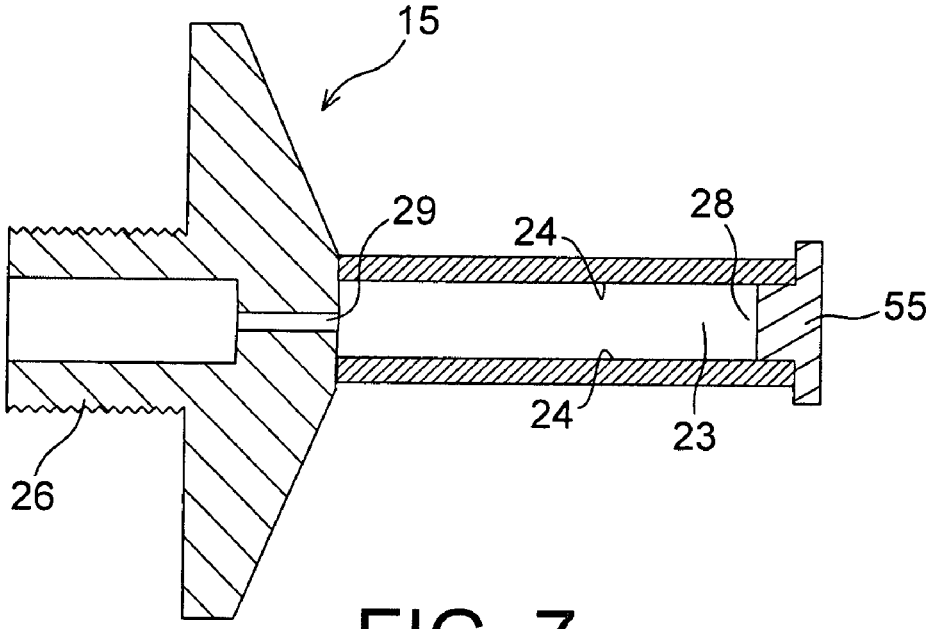
FIG. 7 is a diagram of the second part of a head of a treatment electrode, subject of the present invention.

In the example shown FIG. 7, the cavity 23 is of substantially cylindrical shape, which is a suitable form to contain a spherical or quasi-spherical object 1. The inner diameter of this cylinder, being approximately 50 micrometers to 100 micrometers larger than the maximum size of the object 1 and hence in the order of 150 micrometers to 2.1 millimeters if the object is a microballon 1, is of importance since if it is too small the object 1 will remain immobile within the cavity 23 during the deposit, and if it is too large the contact with the wall 24 will be random and scarcely frequent, and it will not be possible control the deposit rate during electrolytic or chemical galvanic depositing. The reduction electrode 11 may be in the form of at least one body 12 joined to a removable head 13. In the example in FIG. 3A, the body 12 is a metal rod of substantially cylindrical shape. The type of material in which at least part of the reduction electrode 11 is made depends upon the intended deposit. For chemical deposit by displacement or by reduction, the reduction electrode 11 is preferably made in a non-metallic material such as PVC (polyvinyl chloride) or tetrafluoroethylene polymer, to avoid corrosion of the reduction electrode 11. Therefore, during chemical deposit by displacement or by reduction, the depositing of the metal ions contained in the deposit solution on the object 1 is respectively ensured either by displacement owing to the type of metal layer of the object 1, or by reduction from a reducer present in the deposit solution. For electrolytic deposition or chemical galvanic deposition, it is the metal forming another electrode 46 called an oxidation electrode which oxidizes. In this case, if the metal to be deposited is gold, the electrode 11 may be made at least partly in brass.

Figure 4:
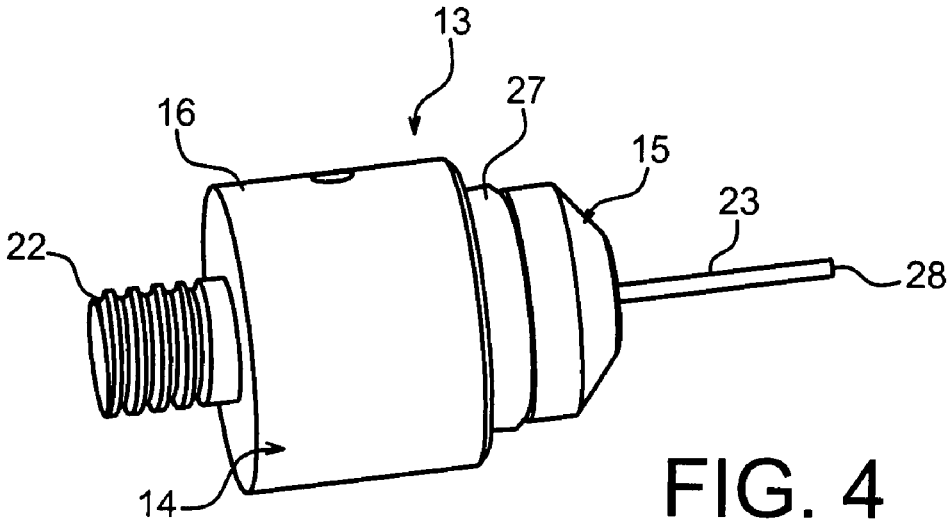
FIG. 4 is a diagram of a head of a treatment electrode, subject of the present invention, whose two parts have been assembled.

The head 13 preferably consists of two parts 14, 15 assembled together. FIG. 4 is a diagram of the head 13 whose two parts 14, 15 are assembled. This assembly can be achieved by screwing for example.

Figure 8:
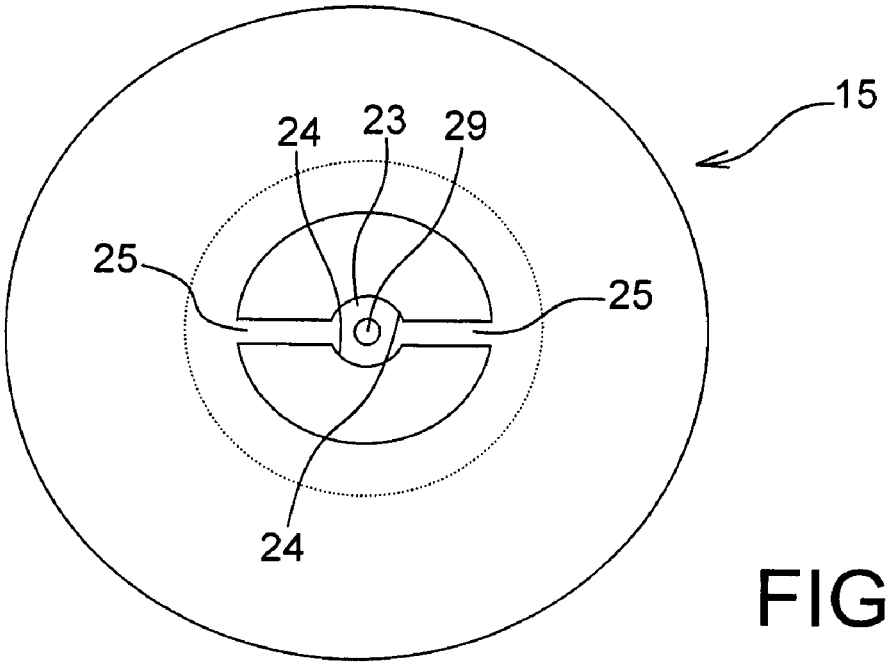
FIG. 8 is a front view of the second part of a head of a treatment electrode, subject of the present invention.
Figure 3B:
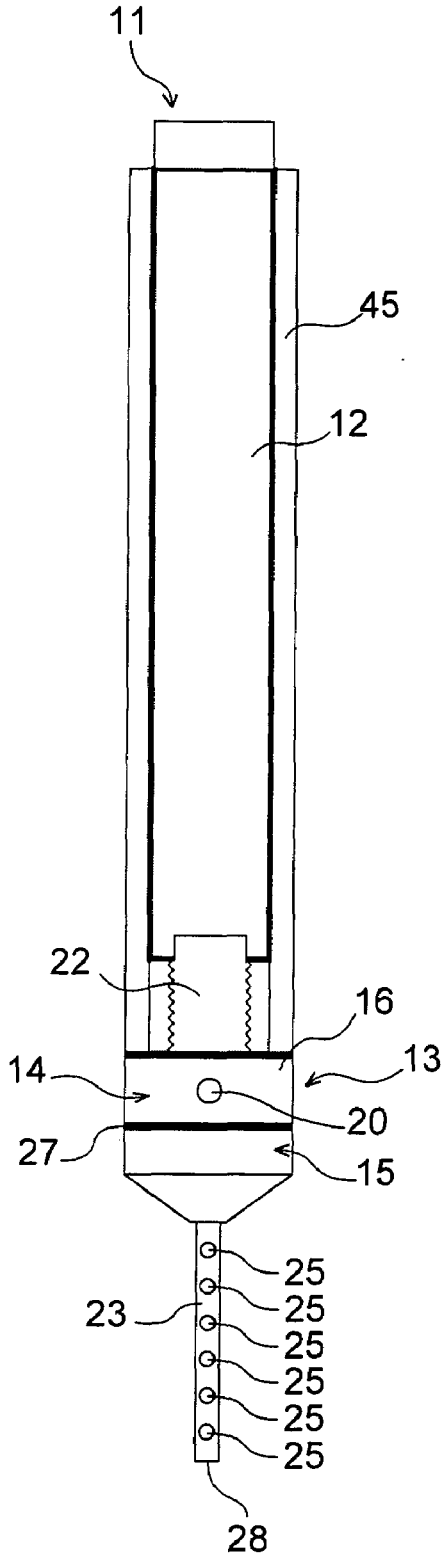
FIG. 3B is a diagram of a treatment electrode, subject of the present invention, according to a second embodiment.
Figure 5:
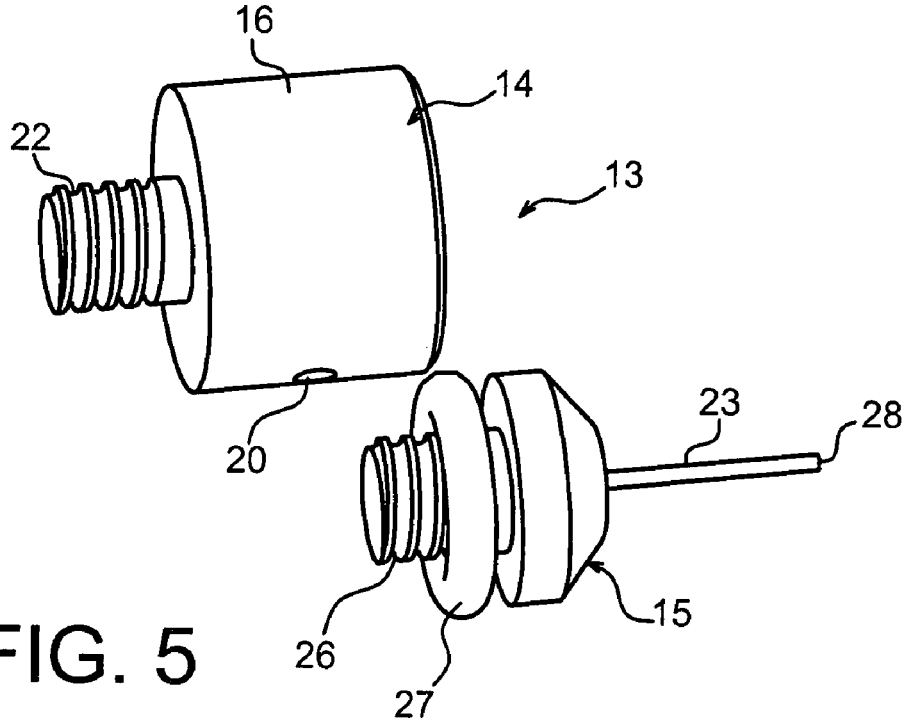
FIG. 5 is a diagram of a head of a treatment electrode, subject of the present invention, whose two parts have not been assembled.
Figure 6:
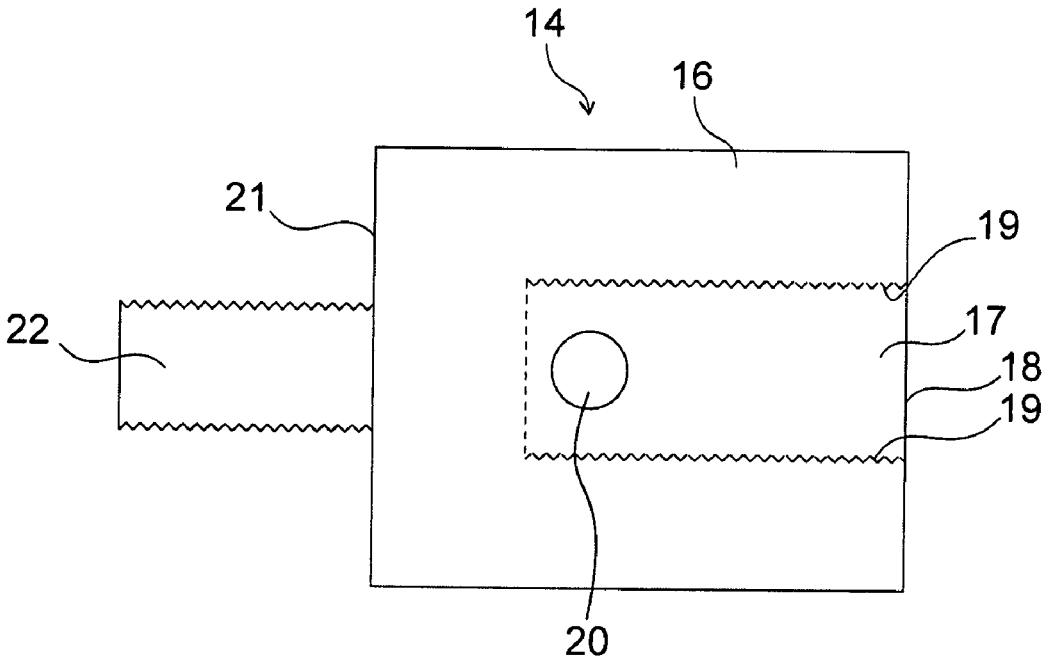
FIG. 6 is a diagram of the first part of a head of a treatment electrode, subject of the present invention.

FIG. 5 shows the head 13 with the two parts 14, 15 non-assembled. The first part 14 is formed of a cylinder 16. This first part 14 forms a chamber 17, which can be seen FIG. 6. A first base 18 of this cylinder 16 is open and comprises a thread 19 partly extending into the chamber 17. This chamber 17 is provided with an orifice 20 which passes through a side wall of the cylinder 16. This orifice 20 is used as gas inlet during the depositing operation. The role of this gas is explained further on in the description of the invention. A threaded cylindrical part 22 lies adjacent to a second base 21 of the cylinder 16 opposite the first base 18. This threaded cylindrical part 22 is used to screw the first part 14 to the body 12 of the reduction electrode 11. The second part 15 is shown FIG. 7. The cavity 23 lies in this second part 15. During deposit, the cavity 23 communicates with the deposit solution via at least one opening 25. In this example of embodiment, the head 13 comprises two openings 25, as shown FIG. 8 which is a front view of the second part 15. Each opening 25 is a slot made along the entire length of the cavity 23. This opening 25 allows the deposit solution to communicate largely with the inside of the cavity 23 when the electrode 11 is immersed in the deposit solution. The dimensions of this opening 25 must guarantee movement of the deposit solution within the cavity 23 whilst preventing egress of the object 1 from the cavity 23. In the described example of embodiment, the width of the slots is smaller than the radius of an object 1 of spherical or near-spherical shape. In another embodiment, there may be an opening 25 of substantially circular shape. FIG. 3B shows a reduction electrode 11 according to a different embodiment from the one shown FIG. 3A. In FIG. 3B, the reduction electrode 11 comprises several openings 25 distributed over the length of the cavity 23.

The second part 15, opposite the cavity 23, comprises a threaded part 26. This threaded part 26 screws into the threaded part 19 of the first part 14. When the two parts 14 and 15 are assembled, a seal 27 is inserted between these two parts 14 and 15 to ensure the imperviousness of the head 13. The removable head 13 may easily be changed whenever it becomes too coated with the metal to be deposited.

The wall 24 of the cavity 23, at one of its ends, is provided with an orifice 28 to insert the object 1 in the cavity 23. This orifice 28 is intended to be plugged by a stopper 55 during the depositing operation as illustrated FIG. 7, so that the object 1 is unable to escape from the cavity 23. At the other end of the cavity 23, an opening 29 places the chamber 17 of the first part 14 in communication with the inside of the cavity 23 when the two parts 14 and 15 of the head 13 are assembled together. This opening 29 is sized so that the object 1 is unable to pass through it. The length of the body 12 of the electrode 11 is adapted so that, during the depositing operation, the object 1 is completely immersed in the deposit solution.

Figure 9:
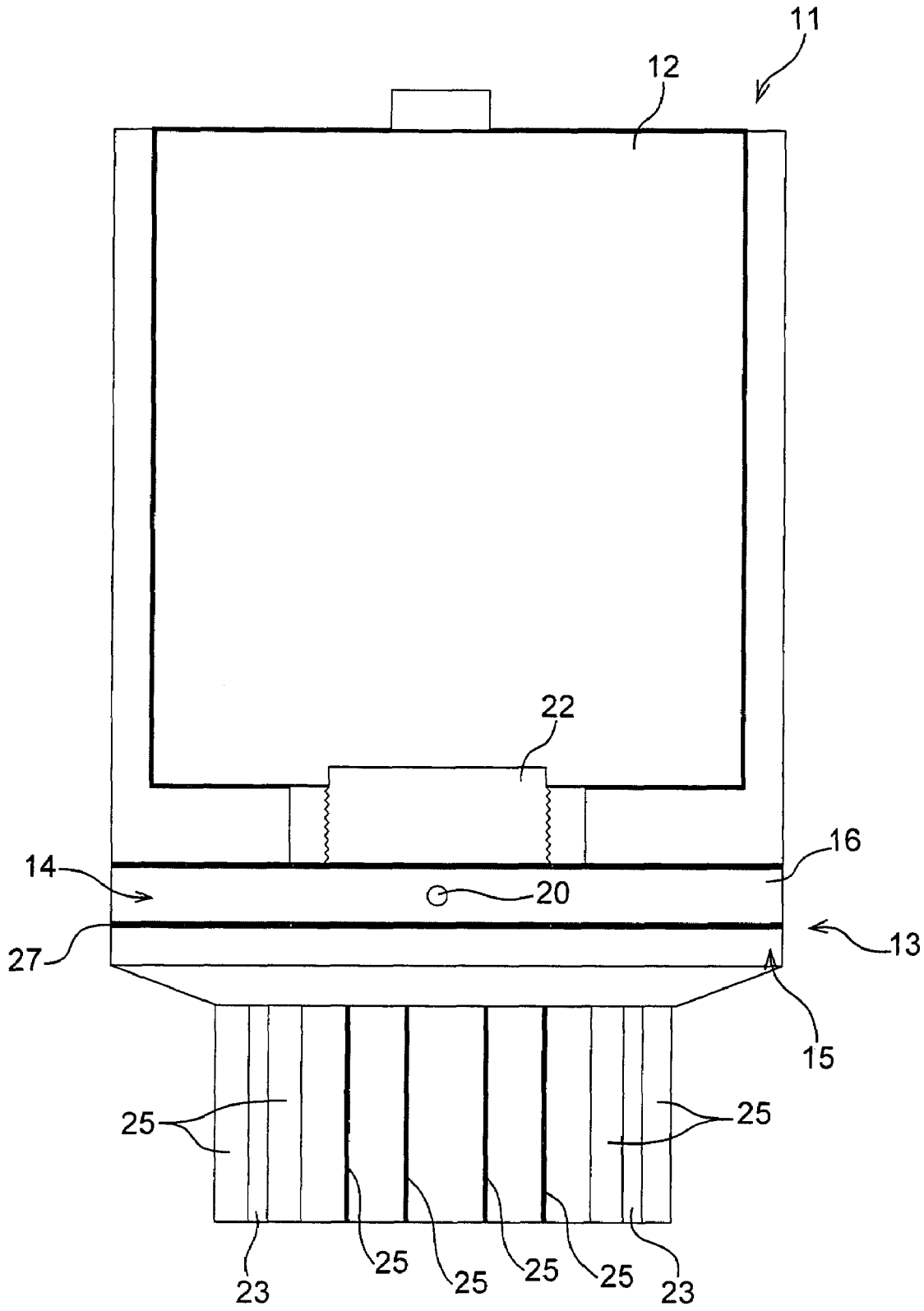
FIG. 9 is a diagram of a treatment electrode, subject of the present invention, according to a third embodiment.
Figure 10:
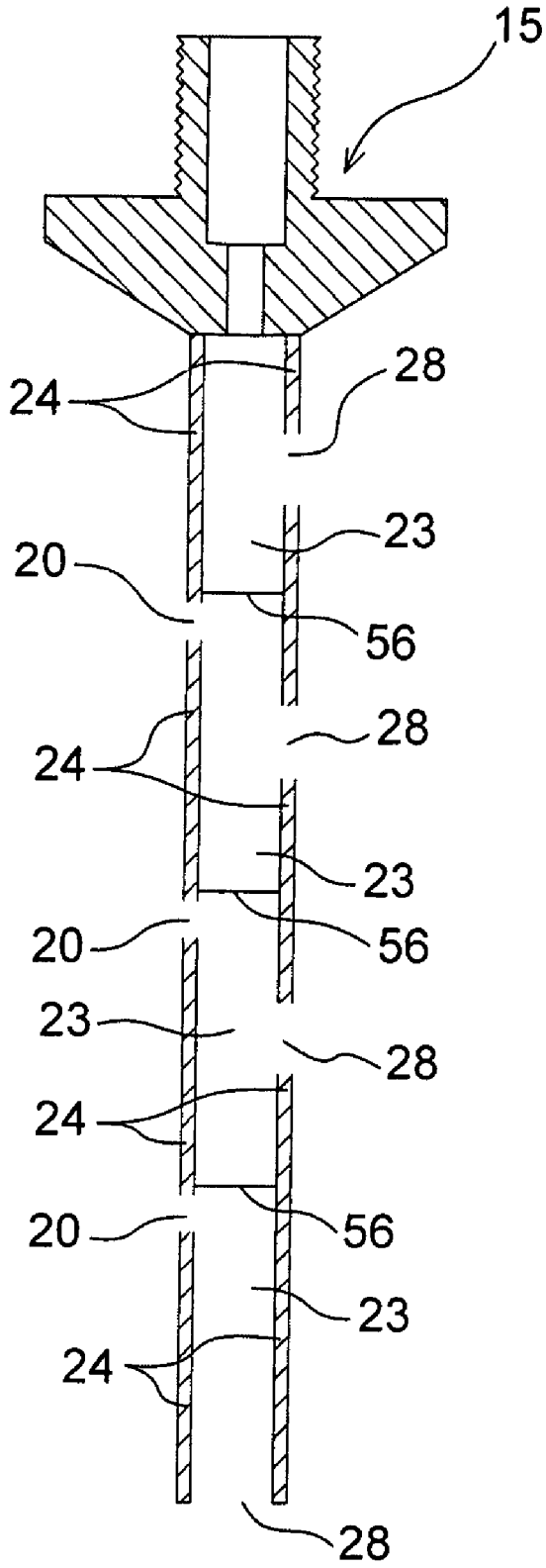
FIG. 10 is a diagram of a treatment electrode, subject of the present invention, according to a fourth embodiment.

In another embodiment, the reduction electrode 11 may comprise a plurality of cavities 23. Each of these cavities 23 may receive an object 1 to be plated. Therefore it is possible to obtain metal depositing on several objects 1 simultaneously, each of these objects 1 being isolated from the other objects 1, thereby preventing any risks of collision as found in prior art devices. These cavities 23 may for example be arranged substantially side by side, forming a ring. FIG. 9 shows a reduction electrode 11 having a plurality of cavities 23 arranged substantially side by side. It could also be contemplated to superimpose these cavities 23 in a column. FIG. 10 shows the second part 15 of the head 13 comprising several cavities 23 superimposed over each other in a column. Each cavity 23 is separated from its adjacent cavities 23 by a wall 56. The walls 24 of some cavities 23 may each be provided with a gas inlet orifice 20. In both these cases, the characteristics of the cavities 23 and more generally of the reduction electrode 11 are the same as described previously.

Each of the methods, subject of the present invention, and its associated implementation device, also subject of the invention, are described below.

The method of metal deposit by oxidoreduction reaction will first be described in its variant of chemical deposit by displacement or reduction.

Figure 11:
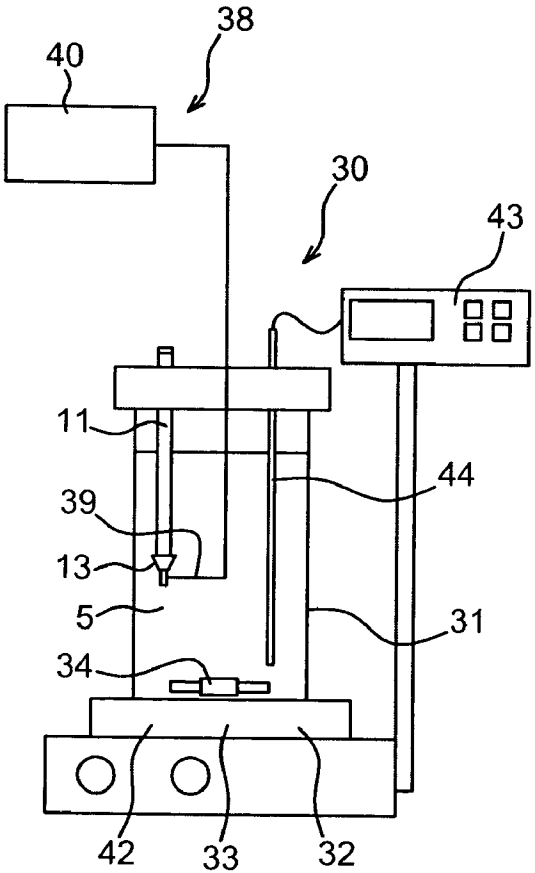
FIG. 11 is a diagram of a device, subject of the present invention, for the application for example of a chemical deposition method by displacement or by reduction, also subject of the present invention.

With reference to FIG. 11 which shows an example of a device 30, subject of the present invention, used for a chemical deposition method by displacement or reduction, also subject of the invention. The device 30 comprises a receptacle 31 intended to contain a deposit solution 5. In this example of embodiment, the deposit solution 5 is an aqueous solution containing nickel in ionic form. This method using displacement or reduction is particularly suitable for depositing a metal less noble than gold e.g. copper or nickel, to a thickness of around ten micrometers, or to deposit gold to a desired thickness not exceeding approximately 1 to 2 micrometers.

The device 30 comprises at least one reduction electrode 11, such as described previously. For this method using displacement or reduction, the body 12 and/or the head 13 of the reduction electrode 11 are made in a non-metallic material.

The object 1 is first placed in the cavity 23 of the reduction electrode 11 via the orifice 28 provided for this purpose. This orifice 28 is then plugged with a stopper 55 e.g in tetrafluoroethylene polymer so that the object 1 cannot escape during the deposit operation.

The reduction electrode 11 is immersed in the deposit solution 5. The oxidoreduction reaction is initiated as soon as the object 1 comes into contact with the deposit solution 5.

The deposit solution 5 is agitated to place the object 1 in movement and in suspension in the deposit solution 5. This agitation is achieved using agitation means 32. In FIG. 11, these agitation means 32 are for example a magnetic agitator 33 acting as support for the receptacle 31 and a magnetic bar 34 placed in the receptacle 31. In another embodiment, these agitation means 32 may for example be an ultrasound device 35 or a device 36, 37 which <<strikes >> the reduction electrode 11. If the object 1 to be plated is a microbeads for example this agitation, in addition to setting the deposition solution 5 in movement, enables the microbeads to be held in suspension within the cavity 23. For lighter objects however, such as a microballoon as in our example of embodiment, agitation will cause the object 1 to rise along the length of the cavity 23 towards the surface of the deposit solution 5. If the object 1 comes to lie at the top of the cavity 23, it must be possible to cause it to move downwards so that it does not remain immobile within the cavity 23 and so that it remains immersed.

To guarantee the imparting of this movement to the object 1, a gas is intermittently injected into the cavity 23. The injected gas is preferably a neutral gas such as nitrogen so as not to modify the pH of the deposit solution 5. Therefore, combined with the agitation of the solution 5, the object 1 is set in movement within the cavity 23 of the reduction electrode 11. For this purpose, the device 30 comprises gas injecting means 38 connected to the gas inlet orifice 20 of the head 13 of the reduction electrode 11. In FIG. 11, these means 38 are a capillary 39 connected to the gas inlet orifice 20 and a peristaltic pump 40 used to send gas bubbles into the cavity 23 at a certain frequency. In another embodiment, these means may be a capillary 39 connected to gas circuit whose flow rate is regulated by a valve 41. Since the gas inlet orifice 20 is located above the cavity 23 in the example in FIG. 3A, the gas bubbles move down in the cavity 23 causing the object 1 to move downwards which then re-rises with the agitation of the solution 5. The frequency at which the gas bubbles are sent, parametered on the pump 40, is preferably chosen such that the object 1 never stagnates in the upper part of the cavity 23. Typically, a gas bubble is sent into the cavity 23 every second. Agitation of the solution 5 also enables the deposit solution 5 to be kept homogeneous and hence also enables sufficient regeneration of the electroactive species close to the surface of the object 1.

If this method uses deposition by displacement, the metal of the object 1 oxidizes and releases electrons. The ions of the metal to be deposited contained in the deposit solution 5 are then reduced on the object 1 by means of these electrons. If this method uses deposition by reduction, the deposit solution, in addition to the metal to be deposited, contains an additional metal in a soluble ionic reduced form. This additional metal oxidizes and then generates the electrons necessary for reduction of the metal to be deposited on the object 1.

In relation to the type of metal to be deposited, it may be necessary to heat the solution 5 during the depositing operation. If nickel for example is to be deposited, it is not necessary to heat the solution 5. On the other hand, if gold is to be deposited, the solution 5 is preferably heated to a temperature of between around 60° C. and 65° C. For this purpose, the device 30 comprises heating means 42. In FIG. 11, these heating means 42 are a hot plate located underneath the receptacle 31, and integrated in the agitation means 32. The device 30 may also comprise means to control the temperature of the solution 5. In FIG. 1, these temperature control means for the solution are an electronic thermometer 43 with a thermocouple 44, said thermocouple 44 being immersed in the deposit solution 5. Other heating means could be envisaged, such as a resistance immersed in the deposit solution 5.

It is also possible, with the device in FIG. 11, to conduct chemical polishing of the object 1. In this case, the electrode 11, subject of the present invention, is a treatment electrode. This treatment electrode 11 is immersed in the solution 5 which is a solution <<attacking >> the material of the object 1 by redox reaction. Therefore polishing is initiated as soon as the object or objects 1 present in the cavity or cavities of the electrode come into contact with the solution 5. The electrode is preferably made at least in part in a material that is inert to the solution 5.

It is also possible to conduct other surface treatments of the object 1, whether metallic or not, other than chemical polishing such as degreasing, anodizing, phosphatizing or nitriding. The conducting of these treatments is identical to the conducting of chemical polishing. The type of treatment solution 5 is adapted to the desired treatment of the object 1.

The method of electrolytic metal depositing will now be described.

Figure 12:
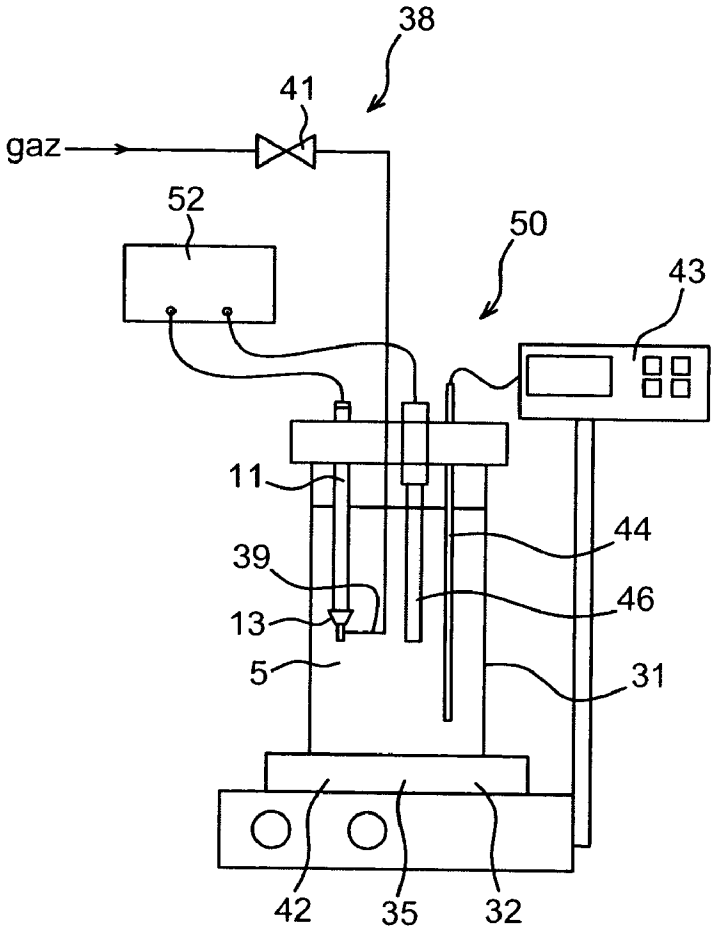
FIG. 12 is a diagram of a device, subject of the present invention, for the application for example of an electrolytic deposition method, also subject of the present invention.

With reference to FIG. 12 which shows an example of device 50, subject of the present invention, used for an electrolytic metal depositing method, also subject of the present invention. The device 50 comprises a receptacle 31 intended to contain a deposit solution 5. In this example of embodiment, the deposit solution 5 is an aqueous potassium aurocyanide solution, therefore containing gold in ionic form. Its chemical composition may, for example, be:

25 grams potassium aurocyanide per liter of solution, 150 grams ammonium citrate per liter of solution, 50 grams citric acid per liter of solution.

The pH of said solution lies between approximately 4 and 5.

This method is suitable for depositing all types of metals, irrespective of desired thickness.

The device 50 comprises at least one reduction electrode 11 such as previously described. In this method, since it is not the metal of the reduction electrode 11 which oxidizes, the electrode may be made differently as shown FIG. 3B. In this FIG. 3B, the body 12 of the reduction electrode 11 is made in brass and is coated with an insulating coating such as a dielectric shield 45 e.g. in plastic material. The head 13 is made in brass and is coated with a gold layer before making the deposit.

Figure 14:
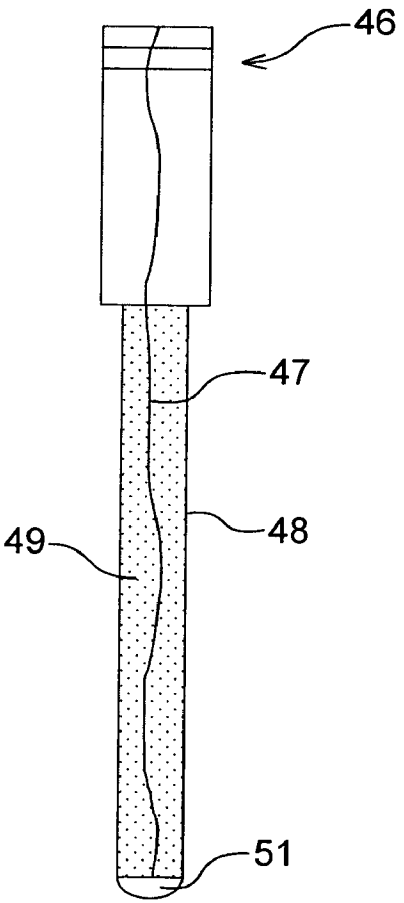
FIG. 14 is a diagram of an oxidation electrode used for a chemical galvanic deposition method, subject of the present invention.

The device 50 also comprises at least one electrode 46 called an <<oxidation electrode >>, which can be seen FIG. 14. This electrode 46 is made in a metal 47 which does not pollute the deposit solution 5 and is therefore not in aluminium for example. For this purpose, the metal 47 is either insoluble e.g. in platinum, gold, stainless steel or titanium, or soluble. If the metal 47 is soluble, it must be identical to the metal to be deposited making it possible via its oxidation to regenerate the deposit solution 5 with metal ions, in this case gold ions. This electrode 46 may for example be formed of a mere wire 47 which is immersed in the deposit solution 5 during the deposit operation.

The object 1 is first placed in the cavity 23 of the reduction electrode 11 via the orifice 28 provided for this purpose. This orifice 28 is then plugged by a stopper 55 e.g. in tetrafluoroethylene polymer so that the object 1 cannot escape during the depositing operation.

The oxidation electrode 46 and the reduction electrode 11 are then immersed in the deposit solution 5 contained in the receptacle 31.

The deposit solution 5 is agitated to place the object 1 in movement and in suspension in the deposit solution 5. This agitation is achieved using agitation means 32. In FIG. 12, these agitation means 32 are an ultrasound device 35. The advantage of this device is that the ultrasounds agitate both the deposit solution 5 and the object 1 thereby improving the homogeneity of the deposit. Similarly to the deposit method using displacement or reduction, in order to guarantee movement of the object 1, a gas is injected inside the cavity 23. The injected gas is preferably a neutral gas. Gas injection means 38 comprise a capillary 39 connected to a gas circuit whose flow rate is regulated by a valve 41.

The oxidation electrode 46 and the reduction electrode 11 are electrically connected to each other via a power source such as a current supply 52. This current supply 52 causes a current to be circulated, here a direct current, within the circuit thus formed, and hence enables a deposit to be made on the object 1 by electrolysis. The current source may also deliver an alternating current, when depositing is termed pulsed depositing. In this case the form of the electric signal is imposed and controlled. Depending upon the current sign, a reduction or oxidation reaction is successively obtained on the surface of the object to be metallized, which may in some cases improve the deposit.

If gold is to be deposited, the deposit solution 5 is heated to a temperature of between approximately 60° C. and 65° C. by heating means 42. In FIG. 12, these heating means 42 are a hot plate located underneath the receptacle 31, integrated in the agitation means 32. The device 50 may also comprise temperature control means for the deposit solution 5. In FIG. 12, these temperature control means for the solution are an electronic thermometer for example 43 with thermocouple 44, sad thermocouple 44 being immersed in the deposit solution 5.

The device shown FIG. 12 may also be used to conduct an electrochemical polishing method, also subject of the present invention. In this case, the electrode 11, subject of the present invention, is an oxidation electrode. The geometry of this electrode 11 is identical to the one described previously with reference to FIG. 3A for example. This electrode 11 is made in an electrically conductive material. Only the polarisation of the electrode 11, here oxidation polarisation, and of the electrode 46, reduction polarisation, differs with respect to the electrolytic deposit so that an oxidation reaction takes place on the oxidation electrode 11 and on the object 1. For this purpose, the oxidation electrode 11 is connected to the negative pole at the current source 52. The oxidation which takes place on the object 1 enables the polishing of this object 1 by removal of material. For example, this method may be performed for electrochemical polishing of a microbeads in tantalum, the oxidation electrode possibly being in tantalum for example, and the reduction electrode being a platinum wire for example having a section of 1 mm and length of 5 mm.

The method of chemical galvanic deposit will now be described.

Figure 13:
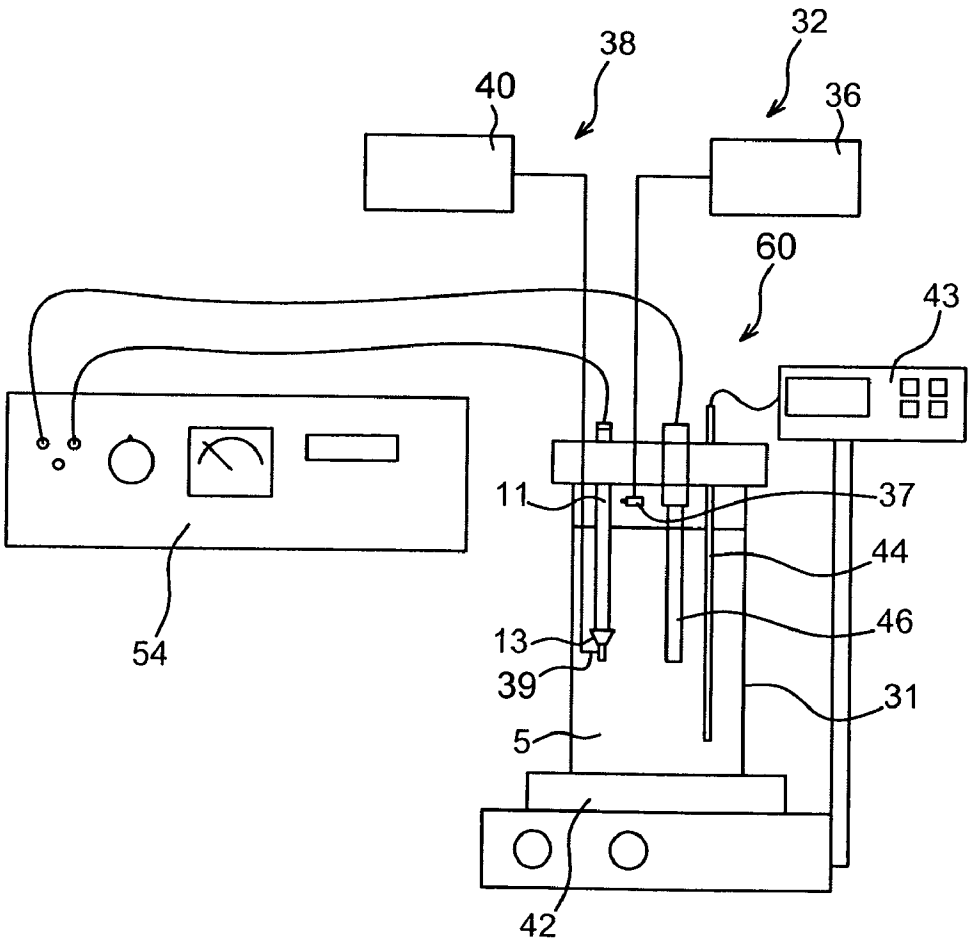
FIG. 13 is a diagram of a device, subject of the present invention, for the application for example of a chemical deposition method by chemical galvanic action, also subject of the present invention.

Reference is made to FIG. 13 which shows an example of a device 60, subject of the present invention, used for a metal deposit method by chemical galvanic action, also subject of the present invention.

The device 60 comprises at least one receptacle 31 containing at least one deposit solution 5. In this example of embodiment, the deposit solution 5 is an aqueous potassium aurocyanide solution, hence containing gold in ion form, identical to the solution in the example of an electrolytic depositing method.

This method is suitable for all types of metals, irrespective of the desired thickness.

The device 60 comprises at least one reduction electrode 11 similar to the one used in the example of the electrolytic depositing method.

The device 60 also comprises at least one oxidation electrode 46 which can be seen FIG. 14. This electrode 46 is made in a metal 47 having a greater reducing power than the metal to be deposited, e.g. aluminium, approximately 99.99% pure. It may for example be formed of a simple aluminium wire 47 immersed in the deposit solution 5 during the depositing operation. But, during the aluminium oxidation process, the wire would end up being coated with gold, which would cause a drop in the depositing rate on the object 1.

To avoid this problem, the oxidation electrode 46 can be protected from the deposit solution 5 and comprise a container 48 e.g. a tube filled with a conductive solution 49. This conductive solution 49 is a saturated potassium chloride solution for example. An aluminium wire 47 is immersed in this conductive solution 49. The container 48 is sealed by an ion junction 51, here sintered glass. The ion junction 51 may also be a gelatinous ion junction. This ion junction 51 allows electric contact between the deposit solution 5 and the conductive solution 49, while physically separating the two solutions 5, 49. Therefore, during the metal depositing process, the electric migration between the two ion solutions is ensured by the electric field created by a potential difference set up between the oxidation electrode 46 and the object 1. In this manner, no gold deposit occurs on the aluminium 47, allowing a guaranteed constant depositing rate on the object 1.

Figure 15:
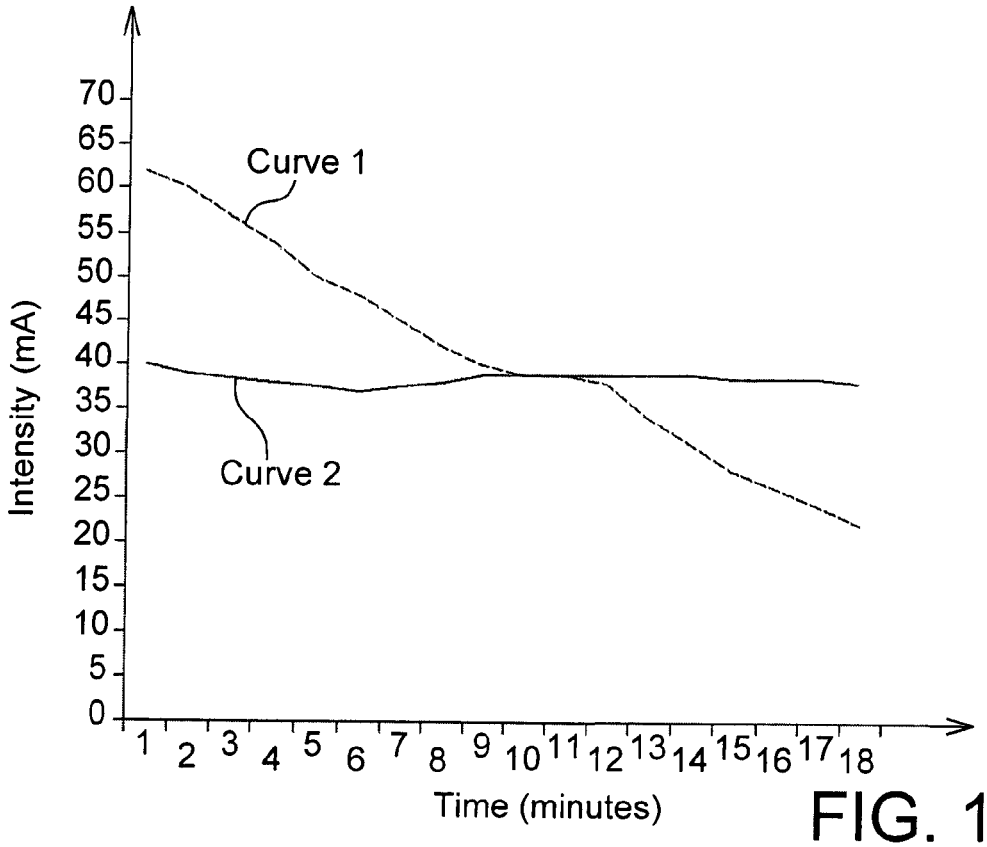
FIG. 15 is a graph showing the electric intensity circulating in the oxidation electrode, with or without insulation of the electrode metal by the deposit solution, during chemical deposition by chemical galvanic action, according to a method subject of the present invention.

FIG. 15 is a graph showing the intensity of the current circulating between the aluminium wire 47 and the object 1 when the aluminium wire 47 is immersed directly in the deposit solution 5 (curve 1) and when it is immersed in a conductive solution 49 separated from the deposit solution 5 by an ion junction 51 (curve 2). It can be clearly seen in curve 1 that the electric intensity drops as depositing progresses in time, which translates as a fall in the depositing rate. Curve 2 shows that the electric intensity remains practically constant over time when the aluminium wire 47 is isolated from the deposit solution 5, which translates as a near-constant depositing rate.

The object 1 is first placed in the cavity 23 of the reduction electrode 11 via the orifice provided for this purpose. This orifice 28 is then plugged by a stopper 55, e.g. in tetrafluoroethylene polymer, so that the object 1 is unable to escape during the depositing operation.

The oxidation electrode 46 and the reduction electrode 11 are then immersed in the deposit solution 5 contained in the receptacle 31.

The deposit solution 5 is agitated so as to place the object 1 in movement and in suspension in the deposit solution 5. This agitation is achieved using agitation means 32. In FIG. 13, the agitation means of the solution 5 are a device 36, 37 which comes <<to strike >> the reduction electrode 11. This device consists of a piston 37 which, at a frequency determined by a signal generator 36, comes to strike the reduction electrode 11. Similar to the manner described with reference to depositing by immersion, in order to guarantee the imparting of movement to the object 1, a gas is injected inside the cavity 23. The injected gas is preferably a neutral gas. Gas injection means 38 are a capillary 39 connected to a peristaltic pump 40.

Figure 16:
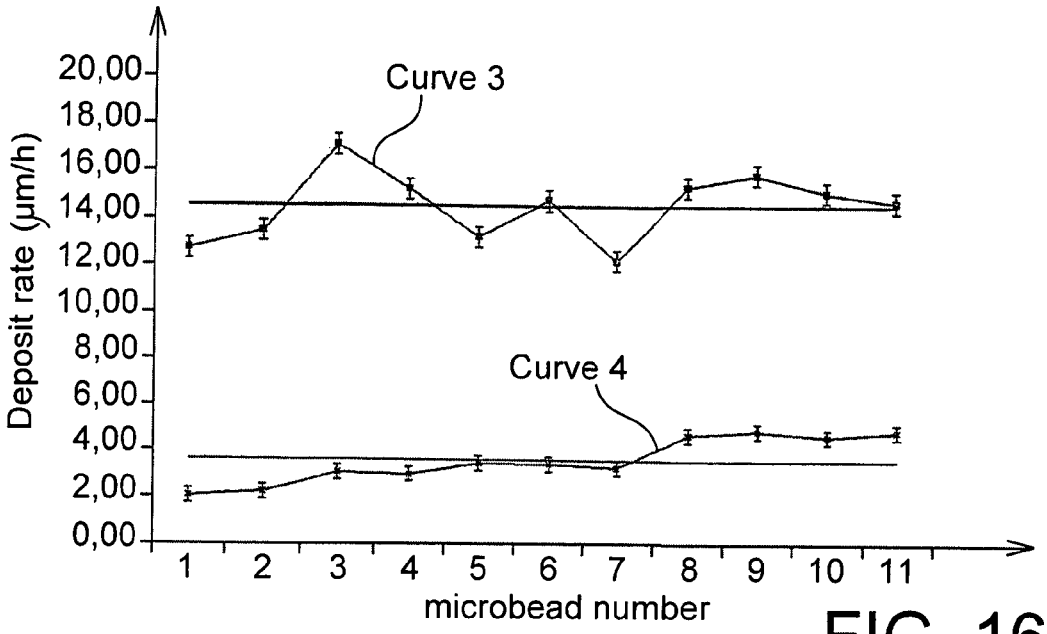
FIG. 16 is a graph showing the rate of deposit in chemical galvanic deposition, according to a method subject of the present invention, with and without a coulometer connecting the two electrodes.

The oxidation electrode 46 and the reduction electrode 11 are electrically connected together. No power source is required for this type of method. This electric connection will allow a current to circulate, and hence allow a deposit to be made on the object 1 by chemical galvanic action when the object is in contact with the wall 24 of the cavity 23 of the reduction electrode 11. This connection may be direct, or it may be obtained via a coulometer 54, as in FIG. 13. FIG. 16 is a graph showing the deposit rates with (curve 3) and without a coulometer 54 (curve 4). The advantage of the coulometer 54 compared with a direct electric connection is that it increases the internal resistance of the circuit. Therefore, it increases the potential difference between the two electrodes 46 and 11. With a direct connection, without the coulometer 54, the resistance of the circuit is approximately 0.1 ohm for a potential difference close to 0 Volt. Under these conditions, the deposit rate is approximately 4 micrometers per hour. If they are connected via a coulometer 54, circuit resistance increases to 170 ohms, thereby increasing the potential difference to 34 millivolts. Ion migration across the ion junction 51 is then sufficient to guarantee a deposit rate in the order of 14 micrometers per hour.

If the deposited metal is gold, the deposit solution 5 is heated to a temperature of approximately 60° C. to 65° C. by heating means 42. In FIG. 13, these heating means 42 are a hot plate located underneath the receptacle 31. The device 60 may also comprise means for controlling the temperature of deposit solution 5. In FIG. 13, these temperature control means of the deposit solution are an electronic thermometer 43 with thermocouple 44, said thermocouple 44 being immersed in the deposit solution 5.

Figure 17:
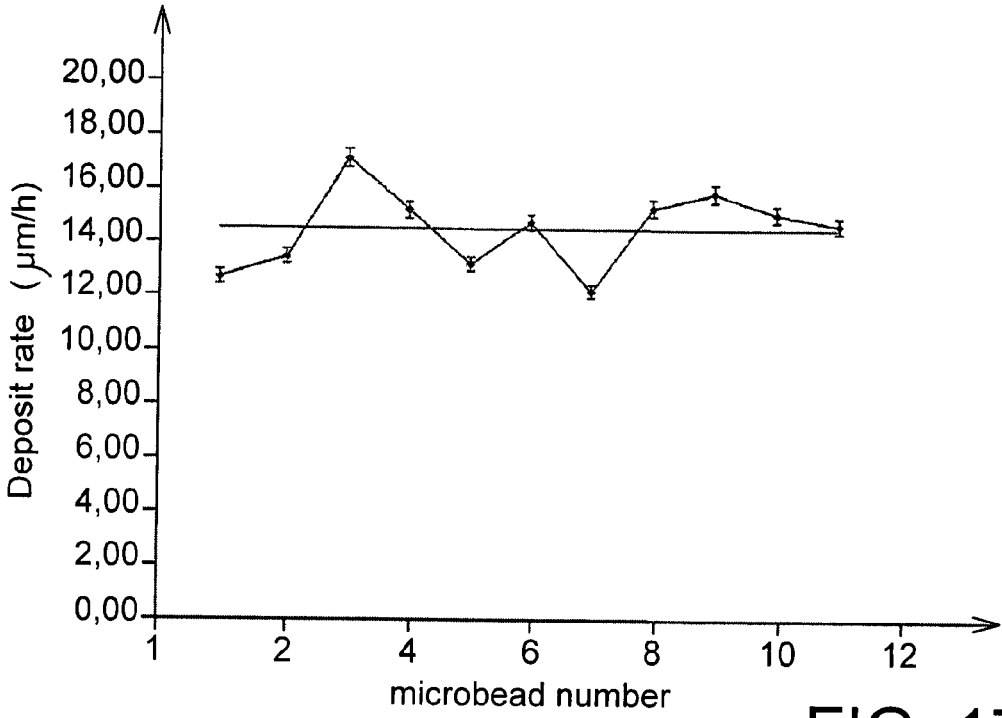
FIG. 17 is a graph showing the deposit rate of several deposits by chemical galvanic action, according to a method subject of the present invention.

FIG. 17 shows the average rate of several deposits made using the chemical galvanic deposit method, with a reduction electrode 11 of the invention. The average rate obtained is 14.5 micrometers per hour ±3 micrometers per hour. These results show that by means of the reduction electrode 11 and of the depositing methods and the devices associated therewith, a reproducible deposit rate is obtained which was not the case with prior art devices.

Different measurements of roughness were made in relation to deposited thickness, using an interferometric microscope of MIR type, with general measurement uncertainty of ±10%, on deposits made using a reduction electrode 11 following a chemical galvanic deposit method according to the present invention. The resulting roughness is very minor since it is only 0.2 micrometer for a deposit thickness of 15 micrometers. By comparison, for the same thickness, the roughness obtained after mounting on a supporting holder and with electrolytic deposit is 0.7 micrometers. The use of the reduction electrode 11, associated with chemical galvanic depositing, therefore makes it possible to reduce the roughness of the deposit by 70% compared with electrolytic deposit on a pellet mounted on a supporting holder.

Figure 18:
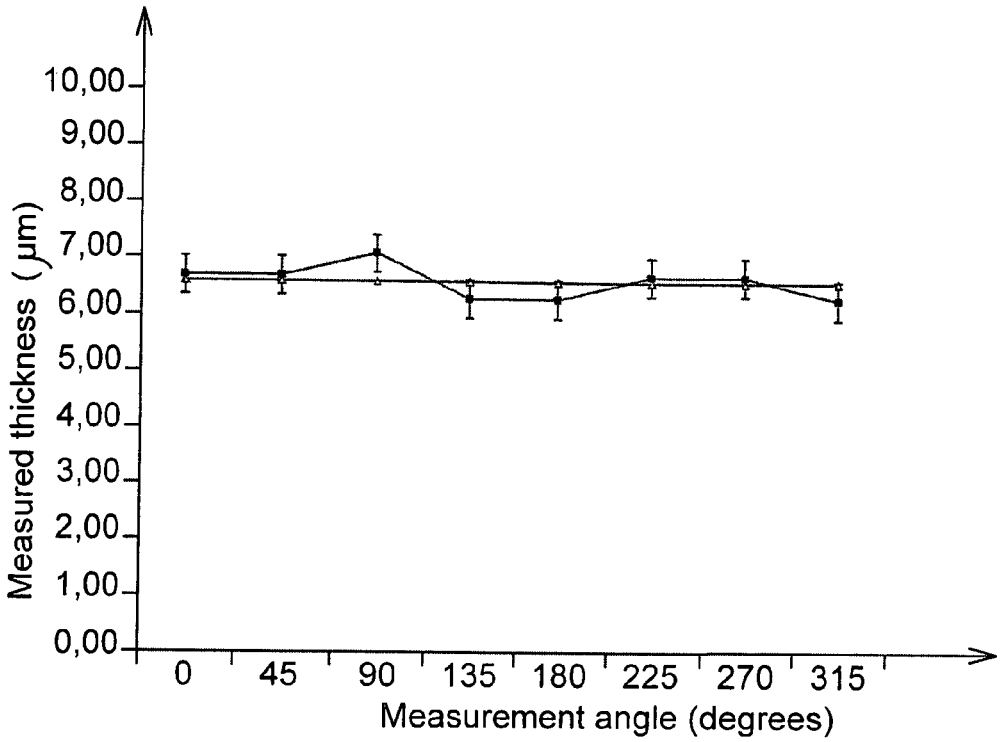
FIG. 18 is a graph showing several measurements of deposit thickness after chemical galvanic depositing, according to a method subject of the present invention.

To verify the homogeneity of the deposit thickness, measurements were made from several measurement angles on a microbeads that was gold plated using a reduction electrode 11 and following a chemical galvanic deposition method, the microbeads being cut into two and measured under a scanning electronic microscope with 5% measurement accuracy. FIG. 18 gives these measurements. The average thickness measured by weighing and by scanning electronic microscope is 6.59 micrometers to an accuracy of ±5%. The standard deviation of the measurements is 0.26 micrometers, which demonstrates that the deposited thickness is perfectly homogeneous on the microbeads. These results also allow confirmation that the density of the deposited gold is identical to the theoretical density, since the calculation of average thickness by weighing is conducted on the assumption that the density of the deposit is equal to the theoretical density.

Although several embodiments of the present invention have been described in detail, it will be appreciated that different changes and modifications may be made thereto without departing from the scope of the invention.

What is claimed is:

1. Electrode for the surface treatment of at least one object, comprising: at least one cavity enclosing the object to be treated during the treatment operation, and whose geometry ensures free movement of the object, this cavity being delimited by a wall comprising at least one opening causing the inside of the cavity to communicate with a treatment solution;

a gas inlet orifice communicating with the cavity, and gas injection means comprising at least one capillary connected to the gas inlet orifice and configured to inject gas in the cavity such that the object does not stagnant in an upper portion of the cavity, wherein the electrode is immersed during the surface treatment, said cavity being substantially cylindrical and having a diameter that is approximately 50 to 100 micrometers greater than the maximum size of the object.

2. Electrode according to claim 1, the wall of the cavity being provided with an orifice to insert the object, this orifice being intended to be plugged by a stopper.

3. Electrode according to claim 1, the opening being of a size to guarantee circulation of the solution within the cavity, while preventing the object from escaping from the cavity.

4. Electrode according to claim 1, the opening being a slot whose width is narrower than the radius of an object of spherical or near-spherical shape.

5. Electrode according to claim 1, comprising a plurality of cavities, said cavities being substantially superimposed over each other in a column, or substantially arranged side by side in a ring.

6. Electrode according to claim 1, comprising a body joined to a removable head which comprises the cavity.

7. Electrode according to claim 6, the body being coated with an insulating coating such as a dielectric shield.

8. Electrode according to claim 6, the head being formed of two parts assembled together, a first part joined to the body forming a chamber provided with the gas inlet orifice, and a second part comprising the cavity, these two parts communicating with each other.

9. Reduction electrode according to claim 1, the wall of the cavity being provided with the gas inlet orifice.

10. Electrode according to claim 1, said electrode being a reduction electrode to implement a metal depositing method by redox reaction on the object that is at least metallized on its surface, the treatment solution being a deposit solution.

11. Reduction electrode according to claim 10, said electrode being at least partly in brass, if the metal to be deposited is gold.

12. Reduction electrode according to claim 10, the electrode being at least in part in a non-metallic material such as PVC or tetrafluoroethylene polymer if the depositing method is a chemical depositing method by displacement or reduction.

13. Reduction electrode according to claim 10, the cavity having a geometry ensuring electric contact of the object with the wall as frequently as possible during its free movement within the cavity when the metal depositing method is electrolytic or chemically galvanic.

14. Electrode according to claim 1, said electrode being an oxidation electrode to implement an electrochemical polishing method by oxidoreduction of the object at least metallized on its surface, said electrode being made at least in part in an electrically conductive material and not interfering with the redox process involved, the cavity having a geometry ensuring electric contact of the object with the wall as frequently as possible during its free movement within the cavity.

15. Electrode according to claim 1, said electrode being made at least partly in a material inert to the treatment solution.

16. Device to implement a method for the surface treatment of an object, comprising:

a receptacle intended to contain a treatment solution;

agitation means to agitate the treatment solution;

at least one treatment electrode to be placed in the receptacle, the treatment electrode comprising: at least one cavity enclosing the object to be treated during the treatment operation, and whose geometry ensures free movement of the object, this cavity being delimited by a wall comprising at least one opening causing the inside of the cavity to communicate with a treatment solution and a as inlet orifice communicating with the cavity, wherein the electrode is immersed during the surface treatment, said cavity being substantially cylindrical and having a diameter that is approximately 50 to 100 micrometers greater than the maximum size of the object; and gas injection means to inject gas in the gas inlet orifice of the treatment electrode.

17. Device according to claim 16 wherein said at least one treatment electrode is a reduction electrode to be placed in the receptacle, the treatment method being a metal depositing method by redox reaction, the treatment solution being a deposit solution.

18. Device according to claim 17, also comprising at least one oxidation electrode to be placed in the receptacle and to be electrically connected to the reduction electrode, either directly or via a coulometer, when the method is a chemical galvanic method.

19. Device according to claim 17, also comprising at least one oxidation electrode to be placed in the receptacle and to be electrically connected to the reduction electrode via a current source when the method used is an electrolytic depositing method.

20. Device according to claim 16, comprising heating means to heat the treatment solution.

21. Device according to claim 16, comprising means to control the temperature of the treatment solution, such as an electronic thermometer with thermocouple to be immersed in said treatment solution.

22. Device according to claim 16, the gas injection means being at least one capillary connecting the orifice to a peristaltic pump or to a gas circuit comprising a flow regulating valve.

23. Device according to claim 16, the agitation means being magnetic, ultrasound or a device which comes to strike the treatment electrode.

* * * * *